US005730060A

United States Patent [19]

Straub et al.

[11] Patent Number: 5,730,060

[45] Date of Patent: Mar. 24, 1998

[54] APPARATUS AND METHOD FOR REMOVING RAIL ANCHORS

[75] Inventors: William Straub, Milwaukee; Jack Hosking, Waukesha, both of Wis.; Mickey Topal, Granite City, Ill.; Bruce Boczkiewicz, Mukwonago, Wis.

[73] Assignee: Nordco Inc., Milwaukee, Wis.

[21] Appl. No.: 653,157

[22] Filed: May 24, 1996

[51] Int. Cl.[6] ..... E01B 29/00

[52] U.S. Cl. ..... 104/17.2

[58] Field of Search ..... 104/2, 17.1, 17.2

[56] References Cited

U.S. PATENT DOCUMENTS

| | | | |
|---|---|---|---|
| 3,722,422 | 3/1973 | Chandre et al. | 104/17.2 |
| 3,766,860 | 10/1973 | McIlrath | 104/17.2 |
| 4,579,061 | 4/1986 | Dieringer . | |
| 4,777,885 | 10/1988 | Dieringer . | |
| 5,074,219 | 12/1991 | Theurer et al. . | |
| 5,117,760 | 6/1992 | Almaraz et al. . | |
| 5,398,616 | 3/1995 | Eidemanis et al. . | |
| 5,438,931 | 8/1995 | Becker et al. . | |
| 5,546,864 | 8/1996 | Straub et al. . | |
| 5,586,502 | 12/1996 | Weber | 104/17.2 |

OTHER PUBLICATIONS

Nordco: Anchor Remover (CSX) videotape, Apr. 20, 1993.

*Primary Examiner*—Mark T. Le

*Attorney, Agent, or Firm*—Greer, Burns & Crain, Ltd.

[57] ABSTRACT

An apparatus for removing a rail anchor from a rail, the apparatus constructed and arranged to be mounted on a railway maintenance vehicle having a frame, and including a scraper for applying a preload against the anchor and for removing the anchor from the rail, and a pusher insert for applying vertical pressure against the anchor to impact and dislodge the anchor from the rail. An improved method for removing a rail anchor from a rail involves applying a preload or a horizontal scraping force against the first, curved end of the anchor with the scraper, applying vertical pressure against the second, knobbed end of the anchor with the pusher to impact and dislodge the anchor from the rail, and removing the dislodged anchor from the rail with the scraper.

9 Claims, 4 Drawing Sheets

"READY"

"DOWN"

"DOWN"

"DOWN"

"DOWN"

APPARATUS AND METHOD FOR REMOVING RAIL ANCHORS

RELATED APPLICATION

The present application is related to commonly assigned, co-pending U.S. patent application Ser. No. 08/434,563, filed May 4, 1995 for "Rail Anchor Remover" now U.S. Pat. No. 5,546,864.

BACKGROUND OF THE INVENTION

The present invention relates to machines and methods used in performing railway maintenance. More particularly, the present invention relates to machines and methods for removing rail anchors from railways.

Conventional railroad tracks generally comprise two rails secured to a plurality of ties by rail fasteners. Rail fasteners can be so-called cut spikes which are driven through tie plate apertures into the wooden railroad ties, or other alternative fasteners configured to perform the same function.

Rail anchors are often used to avoid longitudinal displacement of the rails relative to the ties. The rail anchors, which are generally C-shaped, and include a central blade portion bordered by two clip-bearing ends, are typically attached to the rail base on each side of a tie. Before a tie held in place by the anchor is replaced, the anchor must be either laterally moved or completely detached from the rail. Previously, anchor removal was performed by operators manually hammering the anchors out of their engagement with the rail base.

More recently, rail maintenance machines have been built for detaching rail anchors to ease the physical burden of manually detaching each anchor. The machines are designed to ride on the rails and are provided with reciprocating workheads for detaching the rail anchors. An operator rides on the machine and is responsible for positioning the workheads over the rail anchors. Once the workheads are in place, the operator initiates the detaching process.

Conventional automatic anchor removing workheads include a hammer arranged to press against the rail anchor with sufficient force to detach it from the rail. The vertical pressure applied by the hammer causes the anchor to dislodge from the rail. Once dislodged, the anchor is removed by a supplemental apparatus. When the machine is moved between rail anchors, the workheads are placed in an up position, away from the ties and rails.

However, the accuracy of such machines has been limited. Often the workheads are not properly positioned and the rail anchors do not properly detach. Therefore, the workhead must be re-positioned and the detaching process must be rerun, detracting from the efficiency of the operation.

Furthermore, the conventional workheads are provided with a hammer shape which has a tendency to slip or slide off the rail anchors during the detaching process, again resulting in rail anchors which are not properly detached.

In conventional designs, time is also wasted positioning the workheads between the up and down positions. Because the workheads must be in the up position when the machine is moving, the operator must wait for this repositioning to take place after each rail anchor is removed.

A disadvantage of conventional anchor removing devices is the result of the vertical pressure applied by the hammer to one of the clip-bearing ends of the anchor. It has been found that when the anchor is finally removed from the rail, the anchor is often bent, deformed, or broken as a result of the vertical pressure applied by the hammer. In some cases, the anchor is so severely damaged that it cannot be reused.

Thus, there is a need for a machine which can automatically and reliably remove rail anchors from rails, thus increasing the amount of work that can be performed by an operator during a work day. A need also exists for an improved method of removing anchors from rails in a manner so that the anchor is not severely damaged so it can be reused.

It is an object of the present invention to provide an improved device which can automatically remove rail anchors from rails without manual handling.

It is another object of the present invention to provide an improved rail anchor removing device which can be more accurately positioned over the rail anchors, reducing the number of faulty detaching attempts.

It is still another object of the present invention to provide an improved rail anchor removing device which reduces the amount of slippage that occurs during the detaching process, also reducing the number of faulty detaching attempts.

It is a further object of the present invention to provide an improved rail anchor removing device in which the amount of time spent positioning the workhead between a down and up position is reduced.

It is a still a further object of the present invention to provide an improved rail anchor removing device which can be used with existing railway maintenance machines.

It is yet another object of the present invention to provide an improved method for removing rail anchors from a rail which results in minimal damage to the anchor so it can be reused.

Other features and advantages of the present invention will be apparent from the following description taken in conjunction with the accompanying drawings.

SUMMARY OF THE INVENTION

In order to achieve or exceed the foregoing objects, the present invention provides an apparatus for removing a rail anchor from a rail preferably mounted on a self-propelled, operator directed frame. The apparatus includes a scraper for applying a preload to the rail anchor. The scraper is also used later to remove a dislodged anchor from a rail. The apparatus also includes a pusher for impacting and dislodging rail anchors from a rail. The apparatus is configured so that it may be installed on any existing railway maintenance machine.

The present invention also provides an improved method for removing a rail anchor from a rail. The method includes providing a rail anchor remover apparatus having a pusher assembly for impacting and dislodging a rail anchor from a rail and a scraper assembly for applying a preload on the anchor and removing the dislodged anchor from the rail. Next, a preload, or horizontal scraping force, is applied against the first, curved end of the anchor by actuating the scraper to impact against the first end. Next, vertical pressure is applied against the second, knobbed end of the anchor by actuating the pusher to impact against the second end to dislodge the anchor from the rail. The final step is the removal of the dislodged rail anchor from the rail with the scraper.

The major advantage of this method is that by applying the preload prior to dislodging the anchor, overstressing and excessive loads on the anchor are avoided. As a result, the anchor suffers minimal damage during its removal and can be reused.

DESCRIPTION OF THE PREFERRED EMBODIMENT

Figure 1:
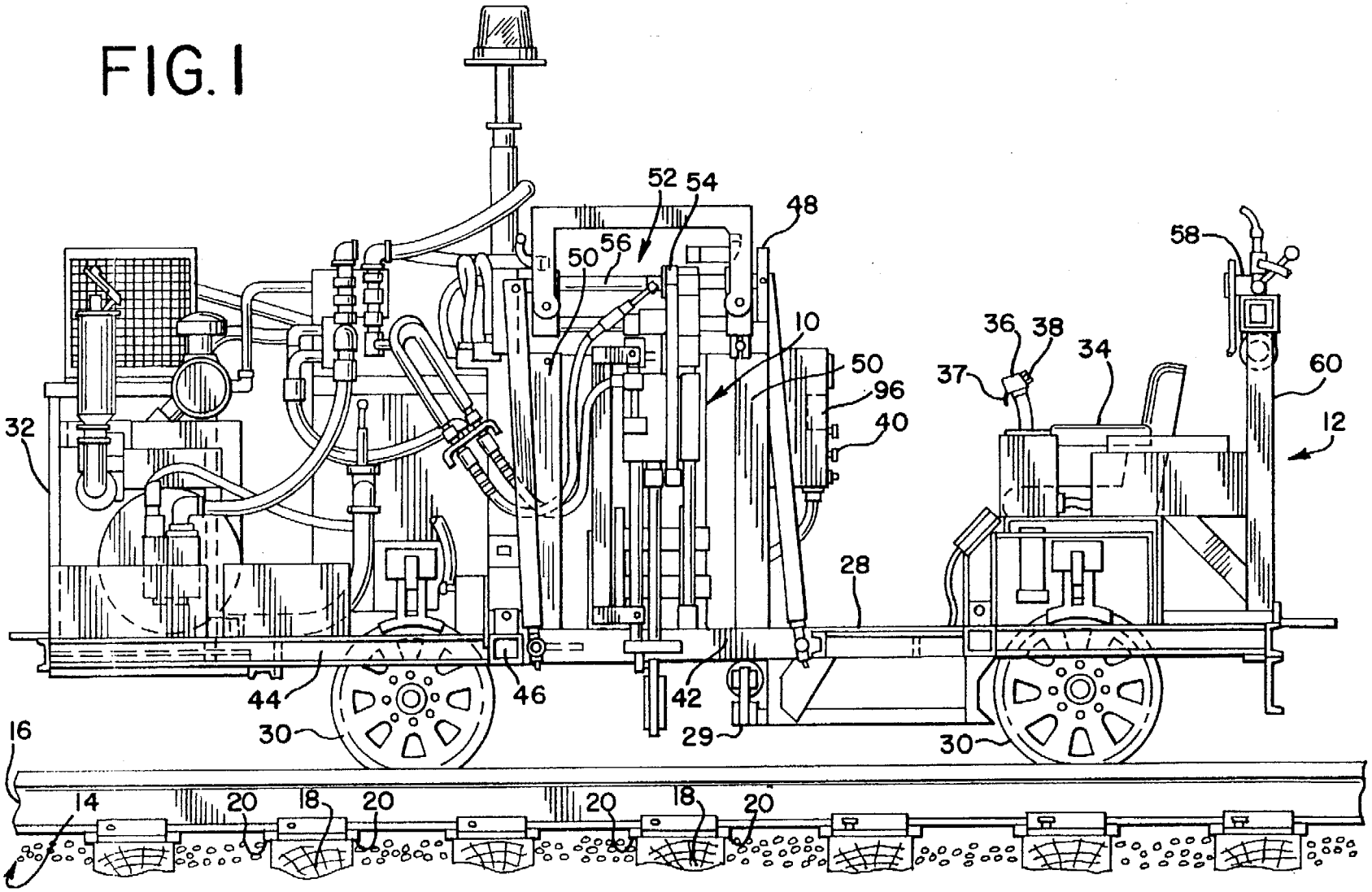
FIG. 1 is a side elevational view of a railway maintenance vehicle of the type suitable for use with the present rail anchor remover.
Figure 2:
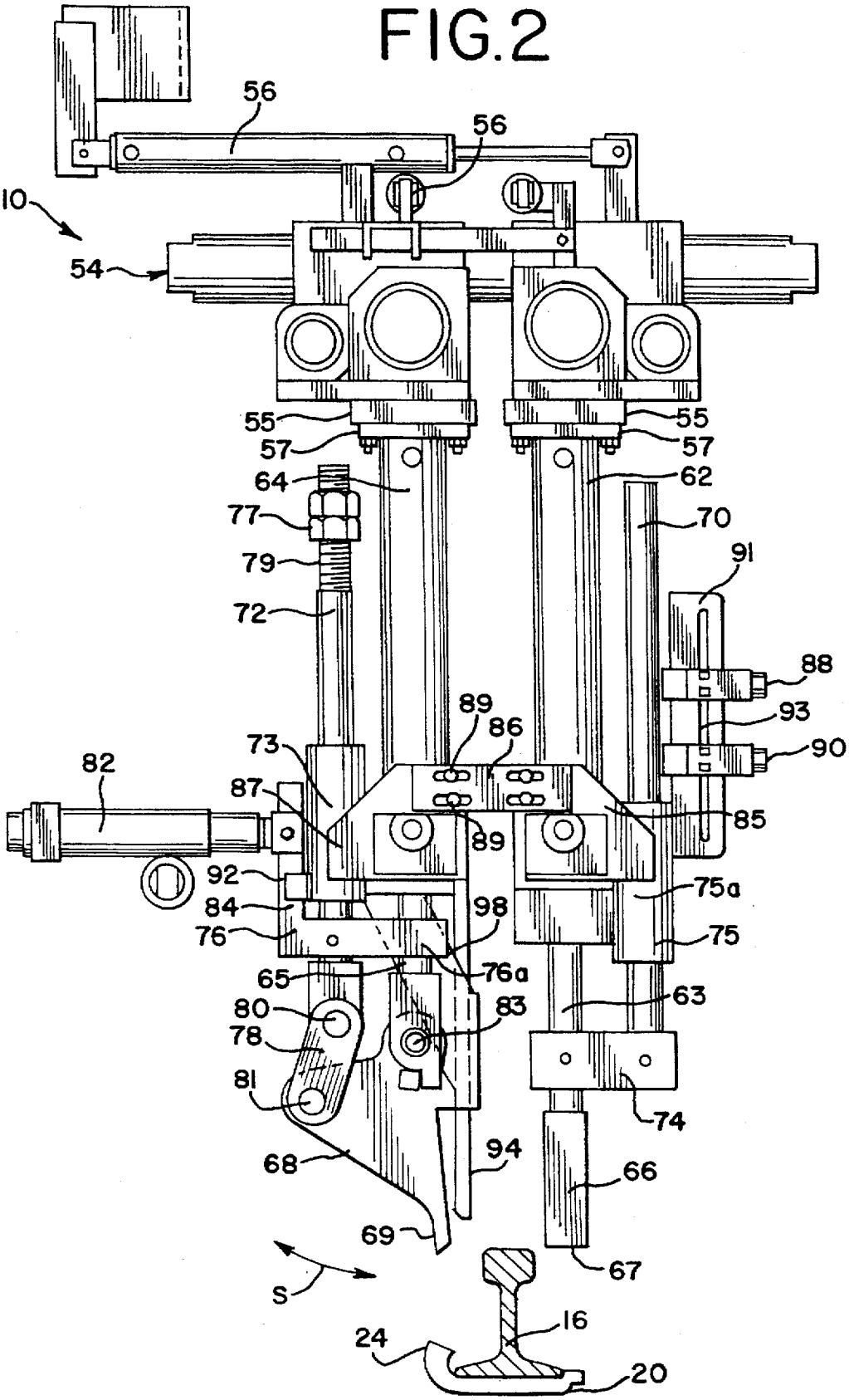
FIG. 2 is a front elevational view of the present rail anchor remover now U.S. Pat. No. 5,546,864, in the work position.
Figure 3:
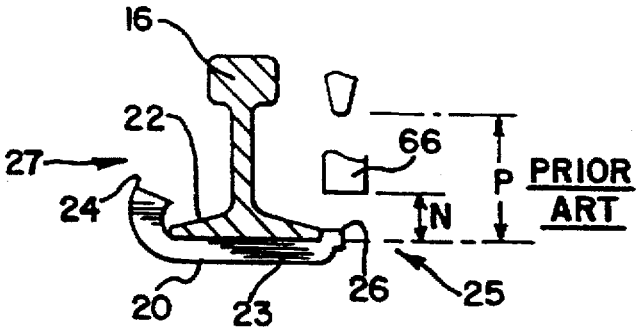
FIG. 3 is a schematic vertical sectional view of a rail with a rail anchor illustrating the traveling heights of the pusher insert for the prior art and the present invention.

Referring now to FIGS. 1 and 3, the present rail anchor remover is generally designated 10 and is designed for mounting upon a railway maintenance machine or base unit, generally designated 12. The machine 12 is preferably designed to be self-propelled on a railroad track 14, however remote propulsion sources are contemplated. Included on the track 14 are a pair of rails 16 (only one pictured), and a plurality of rail support members commonly referred to as ties 18. Rail anchors 20 are attached to the rail base 22 on both sides of specified ties 18 to prevent the rails 16 from moving perpendicular to the ties 18. The rail anchors 20 have a central blade portion 23, a curved end 24 which acts to hook the rail base 22 on the field side 25 of the rail 16 and a knobbed end 26 which abuts the rail base 22 on the gage side 27.

The base unit 12 includes a frame 28 supported on a plurality of wheels 30 such that the frame 28 can be moved along the rails 16. The frame 28 preferably supports a source of motive power 32 such as an internal combustion engine, which propels the unit 12 and also powers the fluid power system, which in the preferred embodiment is hydraulic. Also supported on the frame 28 is at least one operator's seat 34. At least one of the operator's seats 34 is provided with at least one control joystick 36 having at least one trigger 37 and other functional controls such as actuator buttons 38. The operator's seat 34 and the joystick 36 are located in operational proximity to a central control panel 40. The operator's seat 34 is positioned, relative to the rail anchor remover 10, so that the operator is out of the line of action of the removal operation. In this way, the operator is less likely to be injured by objects which may be inadvertently propelled through the air during the removal operation.

Included on the frame 28 are a pair of generally parallel main tubes 42. The main tubes 42 are positioned to be approximately parallel to the rails 16 and are fixed at each end to generally rectangular portions 44, each of the latter including a transversely positioned cross tube 46.

A centrally located, elevated portion 48 of the frame 28 is supported by generally vertical columns 50 which are joined at their respective upper ends by horizontal beams (not shown) to define a generally box-shaped operational zone 52. The operational zone 52 is the area within which the present rail anchor remover 10 is connected. As is common in such equipment, the frame 28 is optionally provided with a rail clamp 29 which secures the frame 28 to the rail 16 during the detaching process. Such rail clamps are well known in the art, and a suitable example is disclosed in U.S. Pat. No. 4,579,061 which is incorporated by reference.

Located at the top of the elevated portion 48 is a spotting carriage 54 for manipulating the rail anchor remover 10 in the directions both parallel and transverse to the rails 16. The carriage 54 includes at least one fluid power cylinder 56 for controlling movement of the rail anchor remover 10 in each of the parallel and transverse directions. Greater details of the construction and operation of the spotting carriage 54 are disclosed in U.S. Pat. No. 5,398,616 which is incorporated by reference herein. If desired, the frame 28 may also be provided with a winch 58, which in the preferred embodiment is mounted on a rear frame guard member 60 located behind the operator's seat 34. Rail anchor removing devices 10 may be provided on both sides of the railway maintenance machine 12 to simultaneously remove rail anchors 20 from both rails 16. In instances where both rails 16 are being de-anchored, additional operators may be required.

Referring now to FIGS. 2 and 4A–4E, the present rail anchor remover 10 is shown in greater detail. The rail anchor remover 10 includes a pusher cylinder 62 and a scraper cylinder 64 both of which are fluid power cylinders and are preferably hydraulic. A pusher shaft 63 slidably extends from a lower end of the pusher cylinder 62. A pusher insert 66 is connected to the pusher shaft 63 and is designed for impacting and dislodging rail anchors 20 from the rail 16. In the preferred embodiment, the pusher insert 66 is elongated, and generally box-like in shape and has a broad, flat hammering end 67 for impacting rail anchors. An advantage of the present rail anchor remover is that the pusher insert 66 is configured to have a larger hammering end 67 than the prior art workheads. An advantage of the present insert 66 is a reduction in the number of faulty detaching attempts. A scraper shaft 65 slidably extends from a lower end of the scraper cylinder 64. A scraper 68 is connected to the scraper shaft 65 and is designed for removing dislodged rail anchors 20 from the rail 16. In the preferred embodiment, the scraper 68 is configured to have an elongated hook end 69 opposite the scraper shaft connection for hooking the curved end 24 of a rail anchor 20.

The pusher insert 66 is positioned on the field side 25 of the rail 16 and the scraper 68 is positioned on the gage side 27 of the rail 16. The pusher shaft 63 and the scraper shaft 65 are configured to respectively vertically reciprocate the pusher insert 66 and the scraper 68.

The cylinders 62 and 64 are each connected to a plate 55 at the lower end of the spotting carriage 54 by an attachment flange 57. In prior anchor removers, the attachment flange 57 has been a structural weak point for the device. During the anchor detaching process, torque forces on the cylinders 62, 64 cause stress on the flanges 57 where they attach to the plates 55 and have been the cause of failures at these points.

In an attempt to eliminate this problem, a generally vertically extending pusher guide rod 70 is provided for guiding the vertical reciprocation of the pusher shaft 63, and a generally vertically extending scraper guide rod 72 is provided for guiding the vertical reciprocation of the scraper shaft 65. By guiding shaft displacement in the vertical direction, the guide rods 70, 72 counteract the damaging operational forces to lessen the stress applied to the attachment flanges 57.

Both guide rods 70, 72 are disposed in a generally parallel relationship to the pusher cylinder 62 and the scraper cylinder 64. The pusher guide rod 70 is connected to the pusher shaft 63 by a pusher guide rod mounting 74, which is pinned to, and vertically reciprocates with, the pusher shaft 63. The pusher guide rod 70 is also connected to the pusher cylinder 62 by a pusher guide 75. The pusher guide 75 is preferably attached to a lower end of the pusher cylinder 62 and is provided with a hollow barrel or sleeve **75*a* through which the pusher guide rod 70** reciprocates.

Similarly, the scraper guide rod 72 is connected to the scraper shaft 65 by a guide support 76, and is configured to vertically reciprocate with the scraper shaft 65. The guide support 76 is secured to the scraper guide rod 72 and is provided with a throughbore 76a through which the scraper shaft 65 reciprocates.

The scraper guide rod 72 is supported in a sleeve mount 73, and is connected to the scraper 68 by a scraper link 78 and scraper pivot pins 80, 81. The scraper shaft 65 is connected to the scraper 68 by a pivot pin 83. A scraper guide stop 77 is provided for stopping the scraper guide rod 72 in the "down" position. In the preferred embodiment, the scraper guide rod 72 is configured to have a threaded upper section 79 and the scraper guide stop 77 is a pair of threaded nuts configured to screw onto the threaded upper section 79. The scraper guide stop 77 is vertically adjustable so that the scraper guide rod "down" position may be adjusted to account for rail height variations.

In operation, the scraper guide rod 72 vertically reciprocates with the scraper shaft 65 until the scraper guide rod 72 reaches a lowermost "down" position. The scraper guide rod 72 reaches the "down" position when the scraper guide stop 77 contacts the sleeve mount 73 stopping the scraper guide rod 72. Next, the scraper shaft 65 continues to move vertically downward to its eventual lowermost "down" position and the scraper link 78 causes the scraper 68 to rotate about pivot pin 83 in an arc indicated by the arrow S substantially transverse to the rail 16.

A stabilizer bracket 82 is connected to the sleeve mount 73 to provide additional stabilization for the scraper shaft 65. Such stabilizer brackets are well known in the art, and a suitable example is disclosed in U.S. Pat. No. 4,777,885, which is incorporated by reference. A stabilizer plate 86 connects the pusher guide 75 to the scraper cylinder 64 and the sleeve mount 73. Respective mounting plates 85, 87 are provided on the pusher guide 85 and the sleeve mount 73 for attachment to the stabilizer plate 86. In the preferred embodiment, the stabilizer plate 86 is provided with a plurality of elongated mounting slots 89 to accommodate relative variations in the position of the cylinders 62, 64.

Provided on the guide support member 75 is a generally vertically extending switch mounting bracket 91. The switch mounting bracket 91 is disposed in a generally parallel relationship to the pusher guide rod 70 and the pusher cylinder 62. In the preferred embodiment, two proximity limit switches 88 and 90 are mounted to the switch mounting bracket 91 for monitoring and controlling the vertical reciprocation Of the pusher shaft 63 and the pusher guide rod 70. The switch mounting bracket 91 has an elongated mounting slot 93 for use in slidably adjusting the positions of the proximity limit switches 88, 90. Therefore, the positions of the proximity limit switches 88, 90 may be adjusted to compensate for variations in rail height.

The upper proximity switch 88 is a "pusher work up/ready" proximity switch which monitors and controls the vertical reciprocation of the pusher shaft 63 and pusher guide rod 70 between an uppermost "work up" position, and a slightly lower "ready" position. In the preferred embodiment, there is an approximate 4–6 inch displacement between the "work up" and "ready" positions.

The lower proximity switch 90 is a "pusher down" proximity switch which monitors and controls the vertical reciprocation of the pusher shaft 63 and pusher guide rod 70 between the "ready" and lowermost "down" positions. The switches 88, 89 are mounted on the switch mounting bracket 91 to monitor the vertical displacement of the pusher guide rod 70, which in turn is representative of the vertical displacement of the pusher shaft 63.

In the preferred embodiment, the "pusher work up/ready" proximity switch 88 and the "pusher down" proximity switch 90 are located about 4 to 6 inches apart. By using the adjustable "pusher work up/ready" proximity switch 88, it is possible to configure the rail anchor remover 10 so that the pusher insert 66 rides closer to the rail 16, in the "ready" position as best shown in FIG. 3. This decreases the amount of time an operator spends positioning the pusher insert 66 between the "ready" and "down" positions.

Provided on the sleeve mount 73 is a "scraper work up/ready" proximity switch 92 which monitors and controls the vertical reciprocation of the scraper shaft 65 between the "work up" and "ready" positions. A generally vertically extending scraper sensor arm 84 is connected to the guide support 76 and is configured to extend vertically upward from the guide support 76 to abut the "scraper workup/ready" proximity switch 92.

The scraper sensor arm 84 vertically reciprocates with the scraper shaft 65 and the scraper guide rod 72. The "scraper work up/ready" proximity switch 92 senses when the upper end of the sensor arm 84 passes the switch 92 and stops and holds the scraper guide rod 74 and scraper shaft 65 in the "ready" position.

Although the preferred embodiment employs proximity switches 88, 90, 92, it is contemplated that mechanical limit switches or other equivalent position sensors may be employed. Furthermore, it is contemplated that a mechanical stop may be employed to stop the guide rods 72, 74 in the lowermost "down" position instead of the "pusher down" proximity switch 90.

A generally vertically extending deflector plate 94 is connected to the scraper cylinder 64 and to the stabilizer plate 86. The deflector plate 94 extends downward from the mounting plate 87 and is configured to prevent the scraper 68 from contacting the rail 16. An angled deflector plate support 98 is provided for securing the deflector plate 94 in position. The deflector plate support 98 is connected to the mounting plate 87 and the deflector plate 94.

In operation, the railway maintenance machine 12 is driven into position by the operator. The rail anchor remover 10, in the "work up" position, is positioned over a rail anchor 20 using the joystick 36 to adjust the position of the spotting carriage 54. When the rail anchor remover 10 is in place, the operator places the pusher shaft 63 and the scraper shaft 65 in the "ready" position by triggering the hand controller trigger 37.

The "pusher work up/ready" proximity switch 88 monitors and controls the disposition of the pusher shaft 63 between the "work up" (best shown in FIG. 2) and "ready" (best shown in FIG. 4A) positions. This is accomplished by reading magnetic fields created by the pusher guide rod 70. The proximity switches 88, 90 sense when the upper end of the pusher guide rod 70 pass the switches 88, 90. As the pusher shaft 63 extends toward the rail 16, the "pusher work up/ready" proximity switch 88 detects the upper end of the pusher guide rod 70, and the switch 88 sends a "ready" signal to the master controller 96 (shown hidden in FIG. 1), located in the control panel 40, which stops and holds the pusher shaft 63 and the pusher guide rod 72 in the "ready" position.

At the same time, the scraper "work up/ready" proximity switch 92 monitors and controls the disposition of the scraper shaft 65 between the "work up" (best shown in FIG. 2) and "ready" (best shown in FIG. 4A) positions. This is accomplished by reading magnetic fields created by the scraper sensor arm 84. The scraper proximity switch 92 senses when the upper end of the scraper sensor arm 84 passes the switch 92. When the "scraper work up/ready"

proximity switch 92 detects the upper end of the scraper sensor arm 84, the switch 92 sends a "ready" signal to the master controller 96 (shown hidden in FIG. 1), located in the control panel 40, which stops and holds the scraper shaft 65 and the scraper guide rod 74 in the "ready" position.

Once the rail anchor remover 10 is in the "ready" position, its position may again be adjusted using the joystick 36 to adjust the position of the spotting carriage 54. During this portion of the anchor detaching process, in applications where a rail clamp 29 is provided, the rail clamp 29 secures the frame 28 to the rail 16. When the operator is satisfied that the rail anchor remover 10 is properly positioned, he initiates the detaching process by actuating one of the buttons 38 on the joystick 36, which causes the work up/scraper shaft 65 and scraper guide rod 72 to mote from the "ready" position (best shown in FIG. 4A) to the "down" position (best shown in FIG. 4B). The scraper guide rod 72 reaches the "down" position (best shown in FIG. 4B) when the scraper guide stop 77 contacts the scraper sleeve 73 stopping the scraper guide rod 72. At this point the scraper shaft 65 continues to move vertically downward to its eventual lowermost "down" position.

The link 78 is configured to cause the scraper 68 to be actuated in the arc S (best seen in FIG. 2) in the direction of the gage side 27 away from the rail 16, when the scraper guide rod 72 is in the stopped "down" position and the scraper shaft 65 continues downward past the scraper guide rod stopping point. While rotating, the hook end 69 of the scraper 68 hooks the curved end 24 of the rail anchor. When the elongated hooked end 69 of the scraper 68 hooks the curved end 24 of the anchor, a horizontal force is applied by the cylinder 64 as a preload 99 against the anchor (best seen in FIG. 4B) to facilitate removal.

Figure 4A:
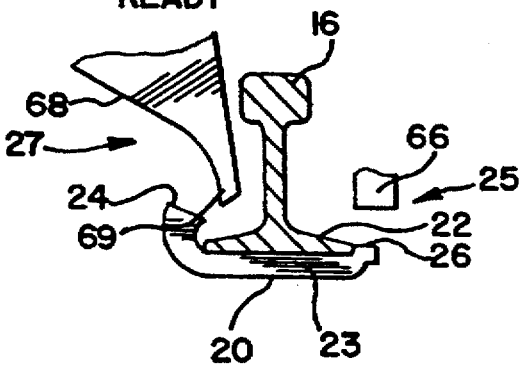
FIGS. 4A–4E are schematic views of a sectional view of a rail with a rail anchor illustrating an improved method for removing a rail anchor from a rail.
Figure 4B:
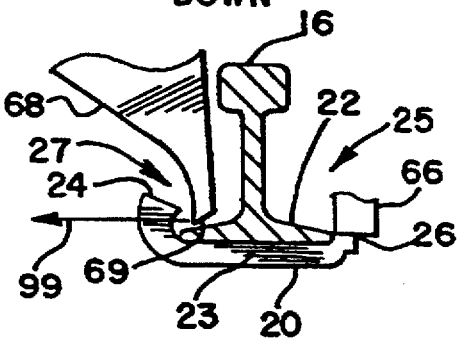
Figure 4C:
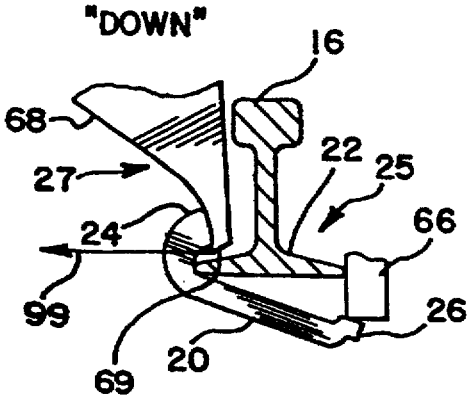

Once the preload 99 is applied to and maintained against the rail anchor 20, the operator actuates a second button 38 on joystick 36, which causes the pusher cylinder 62 to extend the pusher shaft 63 to the "down" position, during which the insert 66 impacts the knobbed end 26 of the anchor on the field 25 side of the rail (best seen in FIG. 4C).

Figure 4D:
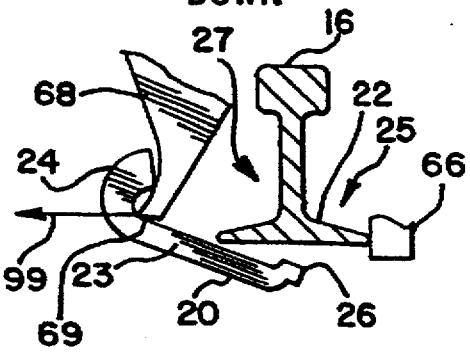
Figure 4E:
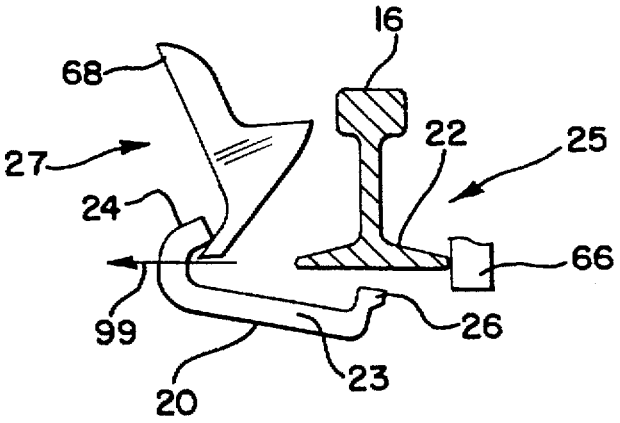

The pusher shaft 63 forces the pusher insert 66 onto the knobbed end 26 of the rail anchor 20, detaching the rail anchor 20 from the rail 16 with vertical pressure (best seen in FIG. 4D).

The "pusher down" proximity switch 90 monitors and controls the disposition of the pusher shaft 63 between the "ready" and "down" positions (best shown in FIGS. 4A–4E, respectively). This is accomplished by reading magnetic fields created by the pusher guide rod 70. The "pusher down" proximity switch 90 senses when the upper end of the pusher guide rod 70 passes the switch 90. When the "pusher down" proximity switch 90 detects the upper end of the pusher guide rod 70, the switch 90 sends a "down" signal to the master controller 96, which stops and holds the pusher shaft 93 and the pusher guide rod 70 in the "down" position.

After the rail anchor 20 becomes detached from the rail 16 by the pusher insert 66, the anchor 20 is immediately and completely removed from the rail by the scraper 68 (best shown in FIG. 4E) as a result of the horizontal force.

When vertical pressure is applied to the rail anchor 20 without first applying the preload 99, it has been found that the rail anchor becomes overstressed and may bend, deform or break. The damage to the anchor 20 is usually so severe that the anchor cannot be reused. The advantage of applying the preload 99 prior to and during the application of vertical pressure is that the preload 99 eliminates excessive loads and overstressing on the anchor 20 during removal. By eliminating excessive loads and overstressing, the anchor suffers minimal damage during its removal and can be reused.

After the rail anchor 20 has been removed, the pusher shaft 63 and the scraper shaft 65 are returned to the "work up" position, and the jail clamp 29 is released from the rail 16. The operator then repositions the railway maintenance machine 12 over the next rail anchor 20 to repeat the anchor removal operation.

In order to speed the removal of rail anchors, it is contemplated that in some applications, two rail anchor removers 10 maybe provided on each side of the railway maintenance machine 12 for each rail, so that the rail anchors 20 on both sides of a tie 18 may be removed simultaneously on each of the two rails of the track. Thus, the machine may be provided with one, two or four anchor removers 10.

While a particular embodiment of the rail anchor remover of the invention has been shown and described, it will be appreciated by those skilled in the art that changes and modifications may be made thereto without departing from the invention in its broader aspects and as set forth in the following claims.

What is claimed is:

1. An apparatus for removing a rail anchor having a field side and a gage side from a rail having a field side and a gage side comprising:

a scraper means for applying a preload to said anchor and for removing said anchor from the rail;

a pusher means for applying vertical pressure to said anchor to impact and dislodge said anchor from the rail; and control means for controlling the operational sequence of said scraper means and said pusher means so that said scraper means exerts said preload upon said gage side of said anchor before said pusher means applies said pressure to said field side of said anchor.

2. The apparatus of claim 1 wherein the preload comprises a horizontal scraping force.

3. The apparatus of claim 1 wherein the scraper means includes a scraper.

4. The apparatus of claim 1 wherein the pusher means includes a pusher insert.

5. A method of removing a rail anchor from a rail, said anchor having a first end on the gage side of the rail and a second end on the field side of the rail, the method comprising the steps of:

a. providing an apparatus for removing a rail anchor from a rail comprising a pusher means for impacting and dislodging said anchor from a rail, and a scraper means for applying a preload to said anchor and for removing the dislodged anchor from the rail;

b. applying a preload against the first end of the anchor by actuating the scraper means to impact against the first end of the anchor;

c. applying vertical pressure against the second end of the anchor, after said preload is applied by said scraper means, by actuating the pusher means to impact against the second end of the anchor to dislodge the rail anchor from the rail; and d. removing the dislodged rail anchor from the rail with the scraper means.

6. The method of claim 5 wherein the preload comprises a horizontal scraping force.

7. The method of claim 5 wherein the scraper means includes a scraper.

8. The method of claim 5 wherein the pusher means includes a pusher insert.

9. The method of claim 5 wherein the first end is curved and the second end is knobbed.

* * * * *